US008092319B1

(12) United States Patent
Cackett et al.

(10) Patent No.: US 8,092,319 B1
(45) Date of Patent: Jan. 10, 2012

(54) IRON-TYPE GOLF CLUB HEAD WITH REDUCED FACE AREA BELOW THE SCORELINES

(75) Inventors: Matthew T. Cackett, San Diego, CA (US); Brandon T. Vincent, Tega Cay, SC (US); Alan Hocknell, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 27 days.

(21) Appl. No.: 12/784,353

(22) Filed: May 20, 2010

Related U.S. Application Data

(60) Provisional application No. 61/180,392, filed on May 21, 2009.

(51) Int. Cl.
*A63B 53/04* (2006.01)

(52) U.S. Cl. ..... 473/330; 473/331

(58) Field of Classification Search ..... 473/324, 473/330, 331; D21/733, 750, 751
See application file for complete search history.

(56) References Cited

U.S. PATENT DOCUMENTS

| | | | | | |
|---|---|---|---|---|---|
| 780,776 | A | * | 1/1905 | Brown | 473/327 |
| D55,278 | S | * | 5/1920 | Kraeuter | D21/750 |
| 2,005,401 | A | * | 6/1935 | Storz | 473/331 |
| D190,430 | S | * | 5/1961 | Penna | D21/751 |
| D210,033 | S | * | 1/1968 | Johnston | D21/750 |
| 4,027,885 | A | | 6/1977 | Rogers | |
| 4,077,632 | A | | 3/1978 | Taylor | |
| D250,282 | S | * | 11/1978 | Brigham et al. | D21/751 |
| 4,558,505 | A | | 12/1985 | Moore | |
| 4,768,787 | A | | 9/1988 | Shira | |
| 5,082,278 | A | * | 1/1992 | Hsien | 473/242 |
| D327,932 | S | * | 7/1992 | Stuff | D21/751 |
| D349,934 | S | * | 8/1994 | Feche et al. | D21/733 |
| 5,354,059 | A | | 10/1994 | Stuff | |
| D353,644 | S | * | 12/1994 | Hirsch et al. | D21/748 |
| D365,616 | S | * | 12/1995 | Lee | D21/748 |
| 5,487,543 | A | | 1/1996 | Funk | |
| D378,114 | S | * | 2/1997 | Hendrickson | D21/748 |
| D379,485 | S | * | 5/1997 | Ragano | D21/749 |
| 5,709,617 | A | * | 1/1998 | Nishimura et al. | 473/330 |
| D400,625 | S | * | 11/1998 | Kubica et al. | D21/733 |
| 6,059,670 | A | | 5/2000 | Mogan | |
| D430,244 | S | * | 8/2000 | Besnard et al. | D21/733 |
| D437,376 | S | * | 2/2001 | Solheim | D21/759 |
| 6,193,615 | B1 | | 2/2001 | Hirota | |
| D443,323 | S | * | 6/2001 | Solheim | D21/759 |
| 6,257,994 | B1 | * | 7/2001 | Antonious | 473/331 |
| D448,824 | S | * | 10/2001 | Koizumi et al. | D21/733 |
| 6,309,310 | B1 | * | 10/2001 | Shira | 473/331 |
| 6,398,665 | B1 | * | 6/2002 | Antonious | 473/330 |
| 6,558,272 | B2 | * | 5/2003 | Helmstetter et al. | 473/329 |
| D527,780 | S | * | 9/2006 | Sanchez et al. | D21/759 |
| 7,179,175 | B2 | | 2/2007 | Kennedy, III | |
| D544,936 | S | * | 6/2007 | Chick et al. | D21/759 |
| 7,448,961 | B2 | * | 11/2008 | Lin | 473/332 |
| 7,452,283 | B2 | | 11/2008 | Hettinger et al. | |
| 7,473,187 | B2 | | 1/2009 | Vokey et al. | |
| 7,717,801 | B2 | * | 5/2010 | Franklin et al. | 473/251 |
| 2003/0032498 | A1 | * | 2/2003 | Erb et al. | 473/331 |
| 2004/0219992 | A1 | * | 11/2004 | Galloway et al. | 473/345 |
| 2006/0025237 | A1 | * | 2/2006 | Aguinaldo et al. | 473/350 |

* cited by examiner

*Primary Examiner* — Sebastiano Passaniti
(74) *Attorney, Agent, or Firm* — Michael A. Catania; Rebecca Hanovice Sonia Lari

(57) ABSTRACT

The present invention provides a novel solution to imparting backspin on high lofted golf clubs. The present invention seeks to define a class of scoreline patterns that result in a higher density of scorelines along the bottom perimeter of an iron face. This in turn, results in increased spin on a golf ball when struck low on the face.

4 Claims, 3 Drawing Sheets

IRON-TYPE GOLF CLUB HEAD WITH REDUCED FACE AREA BELOW THE SCORELINES

CROSS REFERENCES TO RELATED APPLICATIONS

The Present Application claims priority to U.S. Provisional Patent Application No. 61/180,392, filed on May 21, 2009, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a golf club head having a plurality of grooves.

2. Description of the Related Art

The prior art discloses various methods to manufacture golf club heads, especially iron-type golf club heads. For example, Rogers, U.S. Pat. No. 4,027,885 for Golf Iron Manufacture, discloses scoring grooves into a face for the club head.

Taylor, U.S. Pat. No. 4,077,632 for a Lined Face For A Golf Club discloses grooves in compliance with the Rules of Golf at that time.

Moore, U.S. Pat. No. 4,558,505, for a Method Of Making Weighted Metal Golf Club Head discloses at process for making an iron-type golf club head.

Shira, U.S. Pat. No. 4,768,787, for a Golf Club Including High Friction Striking Face discloses grit blasting the horizontal grooves to provide a friction generating surface when the striking surface of the golf club head engages a ball.

Stuff, U.S. Pat. No. 5,354,059, for Golf Club Heads With Means For Imparting Corrective Action, discloses a club head with at least two non-parallel sets of grooves.

Funk, U.S. Pat. No. 5,487,543, for a Shot Peened Golf Club Head, discloses shot peening the striking surface of a golf club head.

Mogan, U.S. Pat. No. 6,059,670, for a Golf Club Having A Head With A Hard Multilayer Striking Surface And Method For Making The Same, discloses manufacturing a club head by heat treatments, vacuum treatments, and roughening.

Doolen, U.S. Pat. No. 6,179,725, for a Golf Club Having Angular Grooves discloses grooves oriented at various angles.

Hirota, U.S. Pat. No. 6,193,615, for a Head Of Golf Clubs That Spins More, discloses a face having grooves that allow for pressure to act specially on the edges of the grooves to increase ball spin.

Vokey et al, U.S. Pat. No. 7,473,187, for Spin Milled Grooves For A Golf Club, discloses machining grooves into a face.

Hettinger et al., U.S. Pat. No. 7,452,283, for a Putterhead With Dual Milled Face Pattern, discloses milling grooves into a face of a putter.

Kennedy, III, U.S. Pat. No. 7,179,175, for a Golf Club Having Stepped Grooves, discloses a golf club head with V-shaped and U-shaped grooves.

Scoreline designs generally have a cross-section geometry that includes two edges, two side walls and a bottom. The side walls are at a predetermined angle from a vertical line. Usually, each wall has more than one section and those sections are straight or curved. Alternatively, the scoreline design is a "V" shape, in which case there is no bottom other than a vertex or fillet radius.

Iron-type golf clubs having scorelines with sharp edges and relatively vertical side walls are advantageous to golfers since such sharp edged grooves allow golfers to induce higher levels of spin on a ball struck with such an iron-type golf club having sharp edged grooves. Iron-type golf clubs without sharp edged grooves or essentially vertical side walls will induce less spin when impacting a golf ball, especially higher-lofted (40 degrees+) golf clubs.

Backspin is the primary mechanism by which a golfer can control a golf ball upon landing after being struck. Backspin is especially important for short shots where proximity to the hole is of greater consequence to the golfer. High lofted clubs (50 degrees to 75 degrees) have grooves designs which are meant to interact with the surface of a golf ball at impact and remove debris from the contacting surface in order to increase friction and thereby impart more spin on the ball.

Prior irons have scoreline patterns wherein the amount of face area below the bottom scoreline at any position across the face is excessive. This is the result of prior irons having scoreline patterns where the individual scorelines, or grooves, are generally co-linear, or parallel and spaced apart by at least 0.075". However, since the bottom of an iron face is generally curved, the scorelines are often offset upward from the bottom of the face, perhaps being minimally close to the bottom at one point but substantially further away from the bottom at most points. This leaves a substantial portion of the face near the bottom perimeter with a reduced density of scorelines. Since this portion of the face tends to be hit most often by golfers, the relative scarcity of scorelines in this area can have an adverse effect on the spin imparted to the ball.

The Rules of Golf as interpreted by the United States Golf Association ("USGA") have constrained the types of scoreline patterns that may be used on golf clubs.

BRIEF SUMMARY OF THE INVENTION

The present invention provides a novel solution to imparting backspin on high lofted golf clubs. The present invention seeks to define a class of scoreline patterns that result in a higher density of scorelines along the bottom perimeter of an iron face. This in turn, results in increased spin on a golf ball when struck low on the face.

The present invention maximizes the number of grooves in contact with a golf ball during an impact. The novel scoreline pattern is based on a higher density of scorelines along the bottom perimeter of an iron-type golf club face.

One aspect of the present invention is an iron-type golf club head having a body and a face. The face has a plurality of scorleines thereon. The plurality of scorelines comprises a plurality of columns of scorelines. Each of the plurality of columns of scorelines offset from an adjacent column of scorelines. Parallel scorelines within a column of scorelines have a parallel spacing greater than 0.075 inch.

Another aspect of the present invention is an iron-type golf club head having a body and a face. The face has a plurality of scorelines thereon. The face having an amount of face area less than 0.12 square inches between the bottom scorelines and the bottom perimeter of the face.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
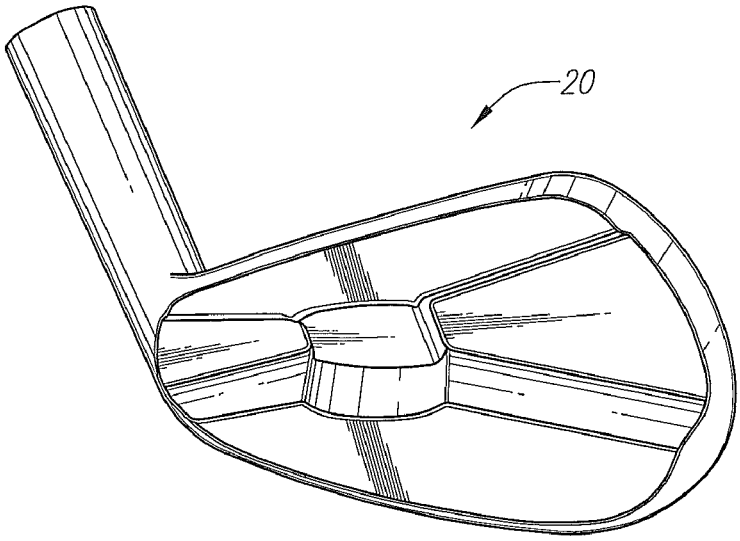
FIG. 1 is a perspective view of an iron-type golf club head.
Figure 2:
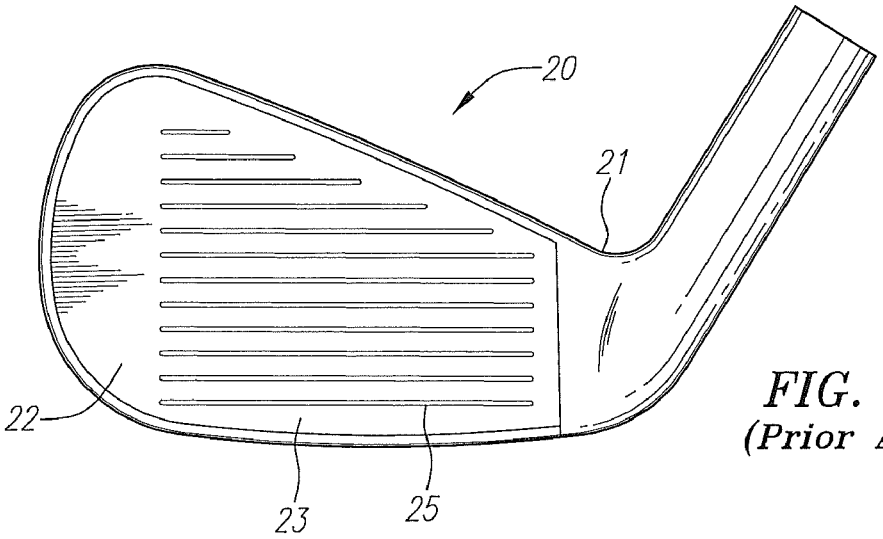
FIG. 2 (Prior Art)
FIG. 2 is a front view of a prior art iron-type golf club head.
Figure 3:
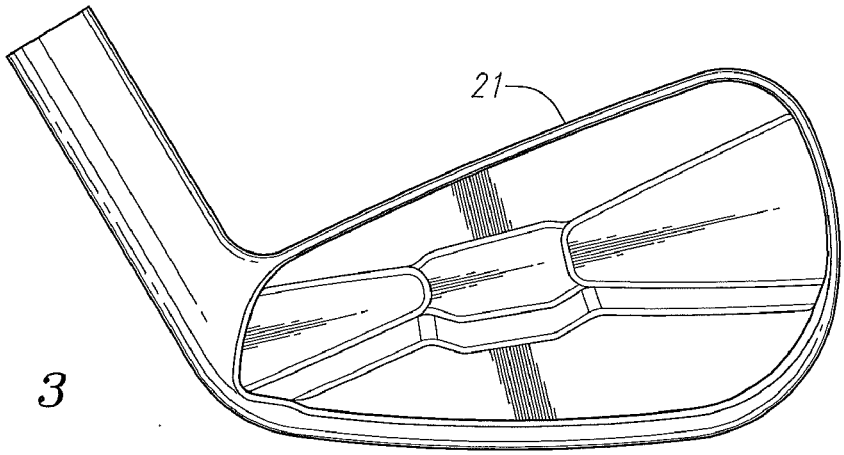
FIG. 3 is a rear view of an iron-type golf club head.
Figure 4:
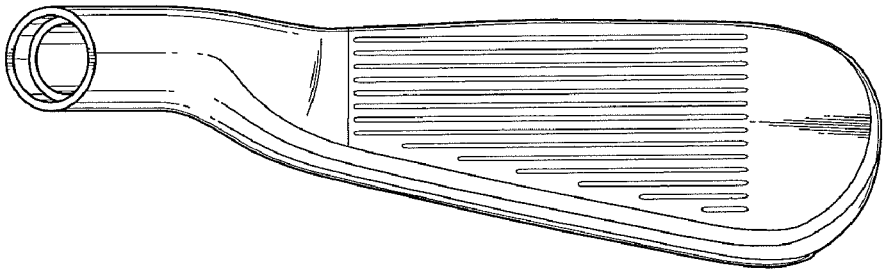
FIG. 4 is a top plan view of an iron-type golf club head.
Figure 5:
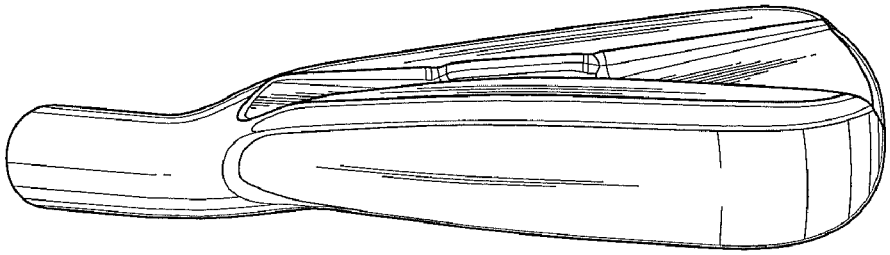
FIG. 5 is a bottom plan view of an iron-type golf club head.
Figure 6:
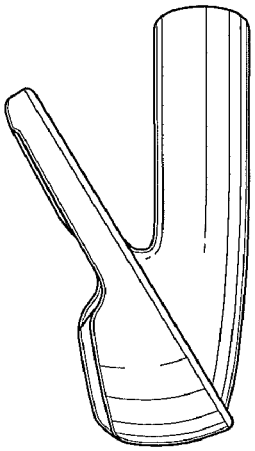
FIG. 6 is a toe side view of an iron-type golf club head.
Figure 7:
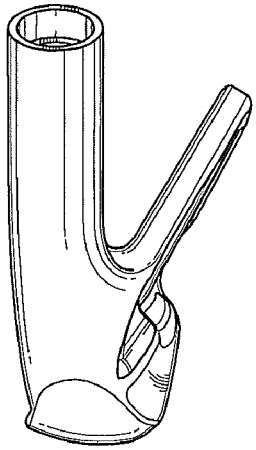
FIG. 7 is heel side view of an iron-type golf club head.

As shown in FIGS. 1 and 3-7, an iron-type golf club is generally designated 20. The golf club head 20 includes a body 21 having a face 22 with a surface 23 and a plurality of grooves 25. The body 21 is preferably composed of a material such as titanium materials, stainless steel, carpenter steel, 1020 steel, amorphous metals and the like. The material of the body 21 preferably has a density between 4 g/cm$^3$ and 10 g/cm$^3$. Such titanium materials include pure titanium and titanium alloys such as 6-4 titanium alloy, 6-22-22 titanium alloy, 4-2 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. The body 21 is preferably manufactured through casting. Alternatively, the body 21 is manufactured through forging, forming, machining, powdered metal forming, metal-injection-molding, electro-chemical milling, and the like.

Figure 8:
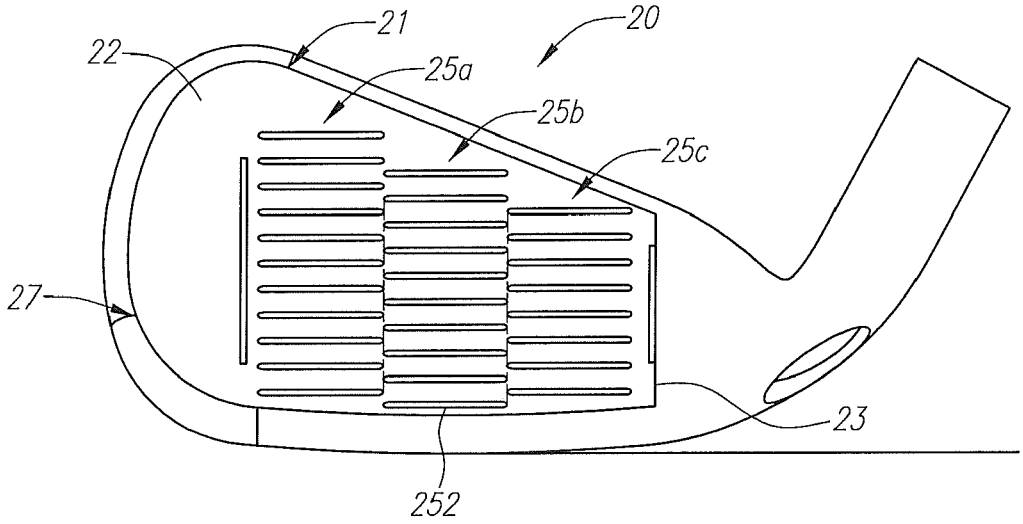
FIG. 8 is a front view of an iron-type golf club head with a scoreline pattern of the present invention.

As shown in FIG. 8, scorelines are parallel to one another, as is typical, but are discontinuous and "offset" or dislocated by an amount less than 0.075".

Figure 9:
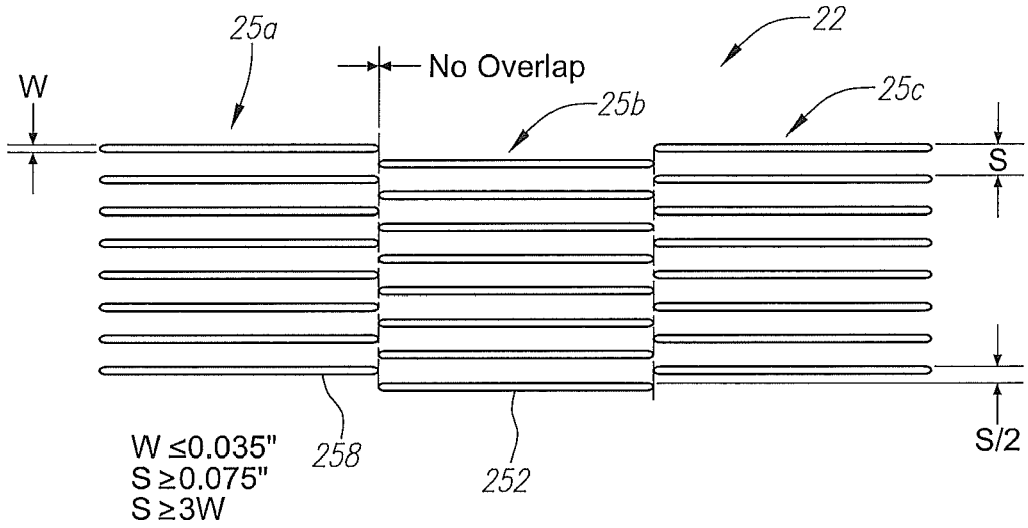
FIG. 9 is an isolated and enlarged view a scoreline pattern of the present invention.

As shown in FIGS. 8 and 9, a first column of scorelines 25*a* is offset from a second column of scorelines 25*b* which is offset from a third column of scorelines 25*c*. The width of each of the scorelines 25 is preferably less than 0.035 inch. The parallel spacing between scorelines 25 within a single column 25*a*, 25*b* or 25*c* is greater than 0.075 inch while the spacing between adjacent scorelines 25, for example 25*x* and 25*z* in FIG. 9, is less than 0.075 inch.

A perimeter 27 of the face 22 is preferably curved. Further, at least one scoreline (25*z* in FIG. 8) is in close proximity to the perimeter 27 of the face in order to minimize the flat surface 23 of the face 22 while providing a maximum number of scorelines 25 to impart more spin on a golf ball impacted by an iron-type golf club containing the novel scoreline pattern.

In a most preferred embodiment, the scorelines of adjacent columns do not overlap but instead end at an imaginary line as shown in FIG. 9.

The spacing between parallel scorelines 25 is preferably three times the width of a scoreline 25.

The effective radius of the curved bottom perimeter 27 of the face is preferably less than 20 inches.

Thus, scoreline patterns that include multiple dislocations are envisioned that allow the overall scoreline pattern to more closely follow the bottom perimeter of the face. A novel scoreline pattern that minimize the amount of face area below the bottom scorelines in an iron-type golf club face.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. An iron-type golf club head comprising:

a body having a face; and a toe column on the face having a plurality of first scorelines;

a center column on the face having a plurality of second scorelines;

a heel column on the face having a plurality of third scorelines;

wherein each scoreline of the plurality of second scorelines is dislocated and shifted perpendicular to an adjacent scoreline of the plurality of first scorelines and the plurality of third scorelines by up to 0.0375 inch;

wherein the face has an amount of face area less than 0.12 square inches between a bottom perimeter of the face and each bottom scoreline of the plurality of first scorelines, the plurality of second scorelines and the plurality of third scorelines.

2. The iron-type golf club head according to claim 1 wherein the iron-type golf club head has a body composed of stainless steel, titanium alloy, carpenter steel, or any combination thereof.

3. An iron-type golf club head comprising:

a body having a face; and a toe column on the face having a plurality of first scorelines;

a center column on the face having a plurality of second scorelines;

a heel column on the face having a plurality of third scorelines;

wherein each scoreline of the plurality of second scorelines is dislocated and shifted perpendicular to an adjacent scoreline of the plurality of first scorelines and the plurality of third scorelines by up to 0.0375 inch;

wherein the face has an amount of face area less than 0.12 square inches between a bottom perimeter of the face and each bottom scoreline of the plurality of first scorelines, the plurality of second scorelines and the plurality of third scorelines;

wherein parallel scorelines within each column of the toe column, the center column and the heel column have a parallel spacing greater than 0.075 inch.

4. The iron-type golf club head according to claim 3 wherein the body is composed of stainless steel, titanium alloy, carpenter steel, or any combination thereof.

* * * * *